US009993026B2

(12) United States Patent
Liu

(10) Patent No.: US 9,993,026 B2
(45) Date of Patent: Jun. 12, 2018

(54) ELECTRONIC CIGARETTE WITH ADJUSTABLE VENTILATION AREA

(71) Applicant: HUIZHOU KIMREE TECHNOLOGY CO., LTD. SHENZHEN BRANCH, Shenzhen, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days. days.

(21) Appl. No.: 15/314,114

(22) PCT Filed: May 28, 2014

(86) PCT No.: PCT/CN2014/078666
§ 371 (c)(1),
(2) Date: Nov. 28, 2016

(87) PCT Pub. No.: WO2015/180073
PCT Pub. Date: Dec. 3, 2015

(65) Prior Publication Data

US 2017/0119056 A1 May 4, 2017

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS 8,983,282 B2 * 3/2015 Bishara ..... F24H 3/002 131/173
9,510,623 B2 * 12/2016 Tucker ..... H01C 17/00
(Continued)

FOREIGN PATENT DOCUMENTS

CA 2857996 A1 * 6/2013 ..... A24F 47/00
CN 203467667 U 3/2014
(Continued)

OTHER PUBLICATIONS

International Search Report of PCT Patent Application No. PCT/CN2014/018666 dated Jan. 28, 2015.

*Primary Examiner* — Tho D Ta

(57) ABSTRACT

An electronic cigarette comprises a suction nozzle assembly, an atomization assembly and a battery assembly. A smoke passageway is defined in the atomization assembly to discharge smoke produced by the atomization assembly. The smoke passageway is communicated to the suction nozzle assembly. A first and a second adjustment elements are sleeved on a joint of the electronic cigarette. A first and a second inlet passageways are defined in the first and second adjustment elements respectively. The second adjustment element is rotatable with respect to the first adjustment element to adjust ventilation area at a joint of the first inlet passageway and the second inlet passageway. A gear adjusting mechanism is arranged to control the ventilation area. There are advantageous effects of adjusting the air inflow rate, preventing the inlet passageway from being blocked, and avoiding changing air flow rate by a mistaken touch to the adjustment element.

13 Claims, 5 Drawing Sheets

(56) References Cited

U.S. PATENT DOCUMENTS

| | | | | |
|---|---|---|---|---|
| 2014/0334804 | A1* | 11/2014 | Choi | A61M 15/06 392/404 |
| 2017/0086506 | A1* | 3/2017 | Rado | A24F 47/008 |
| 2017/0196265 | A1* | 7/2017 | Liu | A24F 47/008 |

FOREIGN PATENT DOCUMENTS

| | | | | |
|---|---|---|---|---|
| CN | 203505589 | U | 4/2014 | |
| WO | WO2013/147492 | A1 * | 10/2013 | A24F 47/00 |

* cited by examiner

ELECTRONIC CIGARETTE WITH ADJUSTABLE VENTILATION AREA

FIELD OF THE INVENTION

The present invention relates to the field of daily electronic products, more particularly, relates to an electronic cigarette.

BACKGROUND OF THE INVENTION

In the prior art, the electronic cigarette comprises an atomization assembly used to atomize tobacco tar, a battery assembly used to power the atomization assembly, and a suction nozzle assembly. A smoke passageway communicated with the suction nozzle assembly is formed in the atomization assembly. An inlet passageway communicated with the smoke passageway is further formed in the battery assembly or the atomization assembly. The inlet passageway is used for airflow to flow into the smoke passageway, thus taking away the smoke produced in the smoke passageway. However, the size of ventilation area of the inlet passageway of the electronic cigarette is configured to be fixed, thus it cannot satisfy user's requirement for different air inflow rates. Therefore, there are drawbacks in the prior art needed to be improved.

SUMMARY OF THE INVENTION

The technical problems solved by the present invention is, aiming at the drawbacks in the prior art, to provide an electronic cigarette with adjustable ventilation area.

The technical solutions of the present invention for solving the technical problems are as follows: an electronic cigarette is provided, which comprises an electronic cigarette body and a suction nozzle assembly arranged at one end of the electronic cigarette body, the electronic cigarette body comprises at least one atomization assembly used to atomize tobacco tar and a battery assembly used to power each atomization assembly; an smoke passageway is defined in each atomization assembly to discharge the smoke produced by the atomization assembly, one end of the smoke passageway is communicated with the suction nozzle assembly;

a first adjustment element and a second adjustment element are sleeved on a joint of the electronic cigarette body and the suction nozzle assembly, a first inlet passageway configured for air inflow is defined in the first adjustment element along an axis of the electronic cigarette body, a second inlet passageway communicated with the other end of the smoke passageway and the first inlet passageway is defined in the second adjustment element along the axis of the electronic cigarette body, the second adjustment element is configured to be rotatable with respect to the first adjustment element to adjust ventilation area of a joint of the first inlet passageway and the second inlet passageway; a gear adjusting mechanism is arranged at the first adjustment element and the second adjustment element to control the ventilation area.

In the electronic cigarette provided in the present invention, the gear adjusting mechanism comprises at least one raised portion and at least two recessed portions matched with each raised portion; during the rotation of the first adjustment element with respect to the second adjustment element, each raised portion is optionally engaged with one of the recessed portions to keep the ventilation area in corresponding gear.

In the electronic cigarette provided in the present invention, the first adjustment element comprises a connection base and an adjustment ring, the connection base comprises a first connecting portion and a second connecting portion formed with diameter shrinkage along an axis of the first connecting portion, the suction nozzle assembly is connected to the first connecting portion; the adjustment ring is fixedly sleeved on the second connecting portion, the second adjustment element is rotationally sleeved on the second connecting portion along an axis of the second connecting portion and located between the first connecting portion and the adjustment ring, the first inlet passageway is arranged on a side wall of the adjustment ring along an axis of the adjustment ring.

In the electronic cigarette provided in the present invention, at least a pair of first protrusions is defined on an inner wall of the second adjustment element, both first protrusions of each pair are distributed with spacing, and the second inlet passageway is formed between both first protrusions of each pair distributed with spacing; at least a pair of second protrusions is defined on an inner wall of the first adjustment element, both second protrusions of each pair are distributed with spacing, and the first inlet passageway is formed between both second protrusions of each pair distributed with spacing.

In the electronic cigarette provided in the present invention, the first connecting portion and the second connecting portion are both in a circular-tube shape; at least one notch is defined on one end of the second connecting portion and the end of the second connection portion is away from the first connecting portion, each notch runs through a side wall of the second connecting portion; when the second adjustment element is sleeved on the second connecting portion, each pair of the first protrusions are rotatable around the axis of the second connecting portion to be received in the notch.

In the electronic cigarette provided in the present invention, the first adjustment element further comprises an elastic element, the elastic element comprises an arc-shaped elastic strip and two connection pieces arranged on the both ends of the elastic strip respectively, the middle portion of the elastic strip upheaves outwardly to form the raised portion; the recessed portions are formed on the corresponding position of the inner wall of the second adjustment element, the recessed portions are in a groove shape;

at least one snap slot and a through-trough are defined at a bottom of each notch, the elastic strip is distributed along an inner side wall of the second connecting portion, the connection pieces are clamped in corresponding snap slot, the raised portion extends outside the through-trough and is optionally engaged with the recessed portions.

In the electronic cigarette provided in the present invention, an outer diameter of first connecting portion is greater than that of the second connecting portion, a doughnut-shaped step surface is formed at a joint of the first connecting portion and the second connecting portion, an end of the second adjustment element abuts against the step surface, at least one installation hole is defined on the step surface; the first adjustment element further comprises at least one spring, one end of each spring is installed on a corresponding installation hole, each raised portion is connected to the other end of the spring, the recessed portions are arranged on the end abutting against the step surface and are in a groove shape.

In the electronic cigarette provided in the present invention, the raised portion is in a ball shape.

In the electronic cigarette provided in the present invention, the electronic cigarette body further comprises a shell, the at least one atomization assembly and the battery assembly are both arranged in the shell.

In the electronic cigarette provided in the present invention, an external threaded sleeve is arranged at one end of the shell, the first adjustment element further comprises a internal threaded sleeve, the internal threaded sleeve is fixed inside the second connecting portion, the outer side wall of the internal threaded sleeve abuts against each pair of the second protrusions and each pair of the first protrusions, the external threaded sleeve is screwed to the internal threaded sleeve, an end of the shell abuts against an end of the internal threaded sleeve.

In the electronic cigarette provided in the present invention, each atomization assembly comprises a tobacco tar latching element used to store the tobacco tar and a heating component used to atomize the tobacco tar, the smoke passageway is formed in the middle portion of the tobacco tar latching element, and the heating component is installed in the smoke passageway.

In the electronic cigarette provided in the present invention, the electronic cigarette body further comprises a atomization support, the at least one atomization assembly is axially provided in the atomization support in parallel, the battery assembly comprises a battery support and a battery arranged in the battery support, the atomization support and the battery support are co-axially provided in the shell, the atomization support is located between the battery support and the suction nozzle assembly.

In the electronic cigarette provided in the present invention, an internal threaded portion is defined in one end of the first connecting portion and the end of the first connecting portion is closed to the suction nozzle assembly, an external threaded portion is defined at one end of the suction nozzle assembly and the end of the suction nozzle assembly is closed to the first connecting portion, the external threaded portion is screwed to the internal threaded portion.

In the electronic cigarette provided in the present invention, an air passageway communicated with one the end of smoke passageway and the second inlet passageway is formed between the atomization support and the shell support, and the end of the smoke passageway is away from the suction nozzle assembly.

An electronic cigarette is further provided in the present invention and comprises an electronic cigarette body and a suction nozzle assembly arranged at one end of the electronic cigarette body, the electronic cigarette body comprises at least one atomization assembly used to atomize tobacco tar and a battery assembly used to power each atomization assembly; a smoke passageway is defined in each atomization assembly to discharge smoke produced by the atomization assembly, one end of the smoke passageway is communicated with the suction nozzle assembly;

a first adjustment element and a second adjustment element are sleeved on a joint of the electronic cigarette body and the suction nozzle assembly, a first inlet passageway configured for air inflow is defined in the first adjustment element along an axis of the electronic cigarette body, a second inlet passageway communicated with the other end of the smoke passage and the first inlet passageway is defined in the second adjustment element along the axis of the electronic cigarette body, the second adjustment element is configured to be rotatable with respect to the first adjustment element to adjust ventilation area at a joint of the first inlet passageway and the second inlet passageway; a gear adjusting mechanism is arranged at the first adjustment element and the second adjustment element to control the ventilation area;

the gear adjusting mechanism comprises at least one raised portion and at least two recessed portions matched with each raised portion; during the rotation of the first adjustment element with respect to the second adjustment element, each raised portion is optionally engaged with one of the recessed portions to keep the ventilation area in corresponding gear;

the atomization assembly comprises a tobacco tar latching element and a heating component, the tobacco tar latching element is in a circular-tube shape, the smoke passageway is formed in the tobacco tar latching element, the heating component is provided in the smoke passageway;

the first adjustment element comprises a connection base and an adjustment ring, the connection base comprises a first connecting portion and a second connecting portion formed with diameter shrinkage along an axis of the first connecting portion, the suction nozzle assembly is connected to the first connecting portion; the adjustment ring is fixedly sleeved on the second connecting portion, the second adjustment element is rotationally sleeved on the second connecting portion along the axis of the second connecting portion, and located between the first connecting portion and the adjustment ring, the first inlet passageway is arranged on a side wall of the adjustment ring along an axis of the adjustment ring;

an outer diameter of first connecting portion is greater than that of the second connecting portion, a doughnut-shaped step surface is formed at the joint of the first connecting portion and the second connecting portion, an end of the second adjustment element abuts against the step surface, at least one installation hole is defined on the step surface; the first adjustment element further comprises at least one spring, one end of each spring is installed on a corresponding installation hole, each raised portion is connected to the other end of the spring, the recessed portions are arranged on the end abutting against the step surface and is in a groove shape.

The present invention has following advantageous effects: as the first adjustment element of the electronic cigarette provided in the present invention is configured to be rotatable with respect to the second adjustment element, the ventilation area at the joint of the first inlet passageway and the second inlet passageway is adjustable, thus satisfying the user's requirement for different air inflow rates. As a gear adjusting mechanism is further arranged between the first adjustment element and the second adjustment element to further fix user's requirement for different air inflow rates at limited gears, it is not only convenient for the user quickly choosing the needed air inflow rate, but also effective for avoiding changing the air inflow rate by mistaken touch to the adjustment element. Furthermore, as the first inlet passageway is defined along the axis of the first adjustment element, it has the advantageous effects of preventing the first inlet passageway from being blocked when the user is holding the electronic cigarette, and preferably avoiding dirt such as the dust and the like entering into the inlet passageway.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

The present invention is further described with reference to the accompanying drawings in the following.

Figure 1:
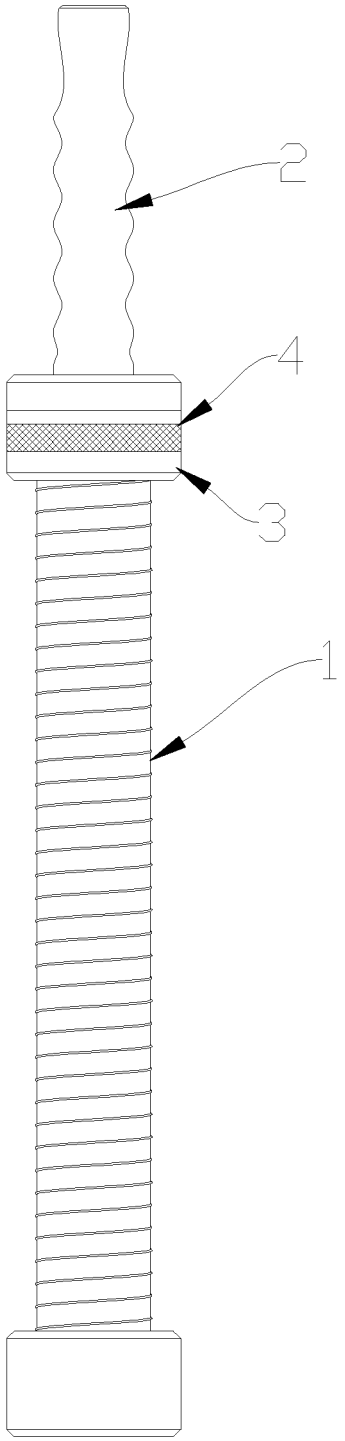
FIG. 1 is an overall schematic view of an electronic cigarette according to a preferred embodiment of the present invention.
Figure 2:
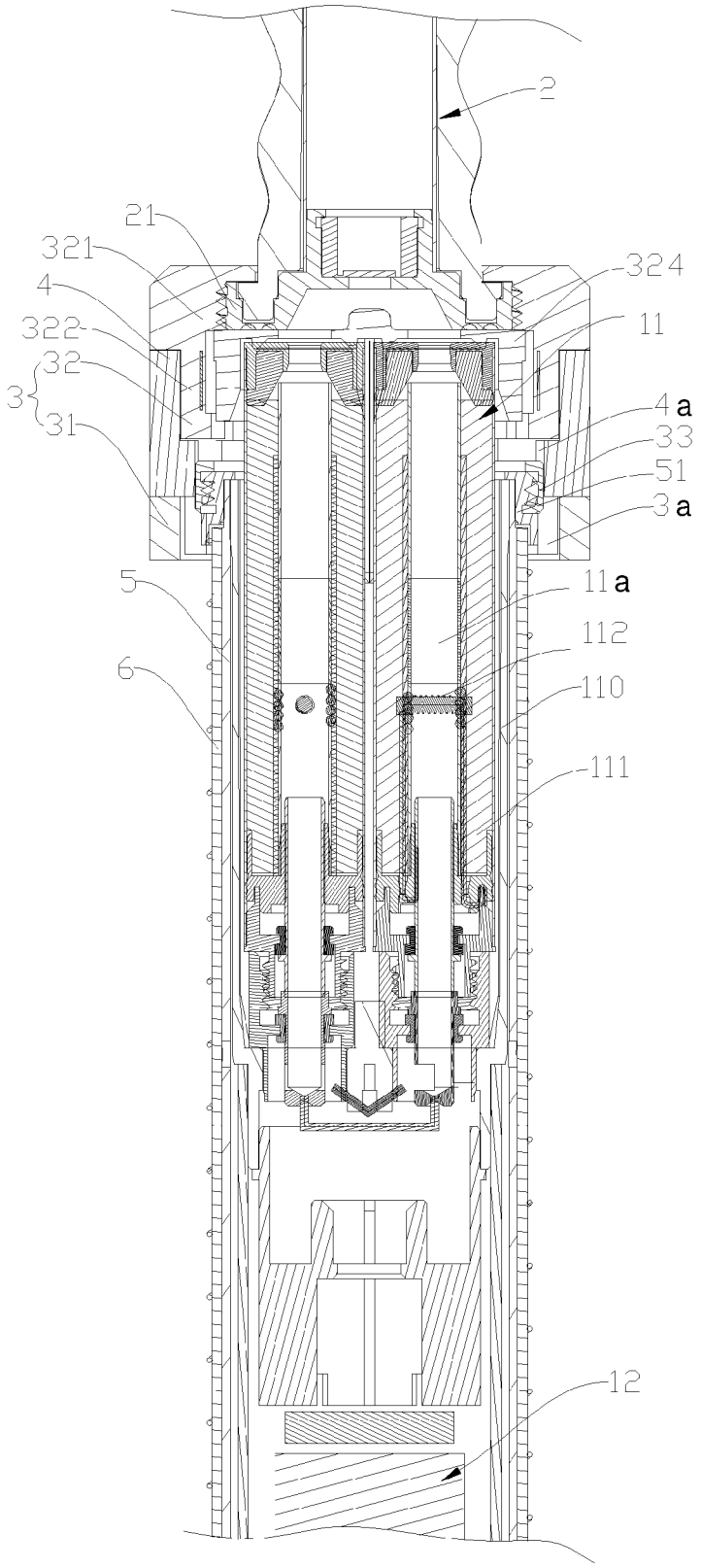
FIG. 2 is a partial section view of the electronic cigarette according to the embodiment shown in FIG. 1.

FIG. 1 is an overall schematic view of an electronic cigarette according to a preferred embodiment of the present invention, As shown in FIG. 1 and refer to FIG. 2, The electronic cigarette comprises an electronic cigarette body 1 and a suction nozzle assembly 2 arranged at one end of the electronic cigarette body 1. The electronic cigarette body 1 comprises at least an atomization assembly 11 used to atomize tobacco tar and a battery assembly 12 used to power the atomization assembly 11. A smoke passageway 11*a* is defined in each atomization assembly 11 to discharge smoke produced by the atomization assembly 11. One end of the smoke passageway 11*a* is communicated with the suction nozzle assembly 2. A first adjustment element 3 and a second adjustment element 4 are sleeved on a joint of the electronic cigarette body 1 and the suction nozzle assembly 2. A first inlet passageway 3*a* configured for air inflow is defined in the first adjustment element 3 along an axis of the electronic cigarette body 1. A second inlet passageway 4*a* communicated with the other end of the smoke passageway 11*a* and the first inlet passageway 3*a* is defined in the second adjustment element 4 along the axis of the electronic cigarette body 1. The second adjustment element 4 is configured to be rotatable with respect to the first adjustment element 3 to adjust ventilation area at a joint of the first inlet passageway 3*a* and the second inlet passageway 4*a*. A gear adjusting mechanism (not shown in the drawings) is arranged at the first adjustment element 3 and the second adjustment element 4 to control the ventilation area.

The first adjustment element 3 is configured to be rotatable with respect to the second adjustment element 4 to adjust the ventilation area at the joint of the first inlet passageway 3*a* and the second inlet passageway 4*a*, thus satisfying the user's requirement for different air inflow rates. In addition, as the gear adjusting mechanism is further arranged between the first adjustment element 3 and the second adjustment element 4 to further fix user's requirement for different air inflow rates at limited gears, it is not only convenient for the user quickly choosing the needed air inflow rate, but also effective for avoiding changing the air inflow rate by mistaken touch to the second adjustment element 4. Furthermore, as the first inlet passageway 3*a* is defined along the axis of the first adjustment element 3, it has the advantageous effects of preventing the first inlet passageway 3*a* from being blocked when the user is holding the electronic cigarette.

Specifically, in the embodiment, the electronic cigarette body 1 further comprises an atomization support 110 and a shell 5. The shell 5 is made of rigid material. A protecting jacket 6 made of elastic material is further sleeved on the outside of the shell 5. The elastic material may be PU leather. The atomization support 110 and the shell 5 are both approximately in a circular tube shape.

There are two atomization assemblies 11 in the embodiment. However, the amount of the atomization assembly 11 is not limited thereto. The two atomization assemblies 11 are arranged side by side in the atomization support 110, with the axes of the two atomization assemblies being parallel to each other. Each atomization assembly 11 comprises a tobacco tar latching element 111 used to store the tobacco tar and a heating component 112 used to atomize the tobacco tar. In the embodiment, the tobacco tar latching element 111 is in a circular tube shape, the smoke passageway 11*a* is formed in the middle portion of the tobacco tar latching element 111, and the heating component 112 is installed in the smoke passageway 11*a*.

The battery assembly 12 comprises a battery bushing, a battery and a control circuit board. The battery and the control circuit board are installed in the battery bushing. The battery bushing and the atomization support 110 are coaxially installed in the shell 5 in sequence. The battery bushing is arranged in one side of the shell 5, wherein the one side of the shell 5 is away from the suction nozzle assembly 2. The atomization support 110 is arranged in another side of shell 5, wherein the side of the shell 5 is closed to the suction nozzle assembly 2. The configuration of the battery assembly 12 is similar to that of a normal electronic cigarette, thus there is no need to repeat here.

An air passageway (not shown in FIG. 1) is formed between the atomization support 110 and the shell 5. The air passageway is configured to connect one end of the smoke passageway 11*a*, away from the suction nozzle assembly 2, to the second inlet passageway 4*a*. That is, an air inlet of the smoke passageway 11*a* is communicated with the second air inlet passageway 4*a* via the air passageway. When smoking, the air flows into the second inlet passageway 4*a* from the first inlet passageway 3*a*, then flows to the air inlet of the smoke passageway 11*a* through the air passageway, and then flows into the suction nozzle assembly 2 from the smoke passageway 11*a*. By means of this aeration configuration, the smoke produced by the atomization assembly 11 can be taken away as more as possible by the air flow puffed in.

The first adjustment element 3 comprises an adjustment ring 31 and a connection base 32. The first inlet passageway 3*a* is arranged on a side wall of the adjustment ring 31 along an axis of the adjustment ring 31.

The connection base 32 comprises a first connecting portion 321 and a second connecting portion 322 which are integrally formed. The second connecting portion 322 is formed with diameter shrinkage along an axis of the first connecting portion 321. The first connecting portion 321 and the second connecting portion 322 are both nearly in a circular tube shape and are arranged coaxially. An outer diameter of first connecting portion 321 is greater than that of the second connecting portion 322. The second adjustment element 4 and the adjustment ring 31 are both sleeved on an outer surface of the second connecting portion 322 in sequence and contacted to each other at their ends. The second adjustment element 4 is located between the adjustment ring 31 and the first connecting portion 321. The adjustment ring 31 is fixed to the second connecting portion 322. The second adjustment element 4 is configured to be rotatable relative to the second connecting portion 322 along an axis of the second connecting portion 322.

An internal threaded portion is defined in one end of the first connecting portion 321, wherein the end of the first connecting portion 321 is closed to the suction nozzle assembly 2. Correspondingly, an external threaded portion 21 is defined on one end of the suction nozzle assembly 2, wherein the end of the suction nozzle assembly is closed to the first connecting portion 321. The external threaded portion 21 is screwed to the internal threaded portion to realize a detachable connection between the suction nozzle assembly 2 and the first connecting portion 321. An elastic sleeve 324 is fixed on one end of the first connecting portion 321, wherein the end of the first connecting portion 321 is closed to the second connecting portion 322. The elastic sleeve 324 is elastically secured on the inner wall of the first connecting portion 321. The elastic sleeve 324 is configured to fix the end of each atomization assembly 11.

The first adjustment element 3 further comprises an internal threaded sleeve 33. The internal threaded sleeve 33 is fixedly secured inside the second connecting portion 322. Correspondingly, an external threaded sleeve 51 is arranged on one end of the shell 5, wherein the end of the shell 5 is closed to the suction nozzle assembly 2. The electronic cigarette body 1 is screwed to the internal threaded sleeve 33 via the external threaded sleeve 51.

In the present embodiment, the gear adjusting mechanism comprises at least one raised portion 381 and at least two recessed portions 42 matched with each raised portion 381. During the rotation of the first adjustment element 3 with respect to the second adjustment element 4, the raised portion 381 is optionally engaged with one of the recessed portions 42 to keep the ventilation area at the joint of the first inlet passageway 3*a* and the second inlet passageway 4*a* in a corresponding gear. Each of the recessed portions 42 corresponds to a gear. When the raised portion 381 is located in different recessed portions 42, the ventilation area changes accordingly.

Figure 3:
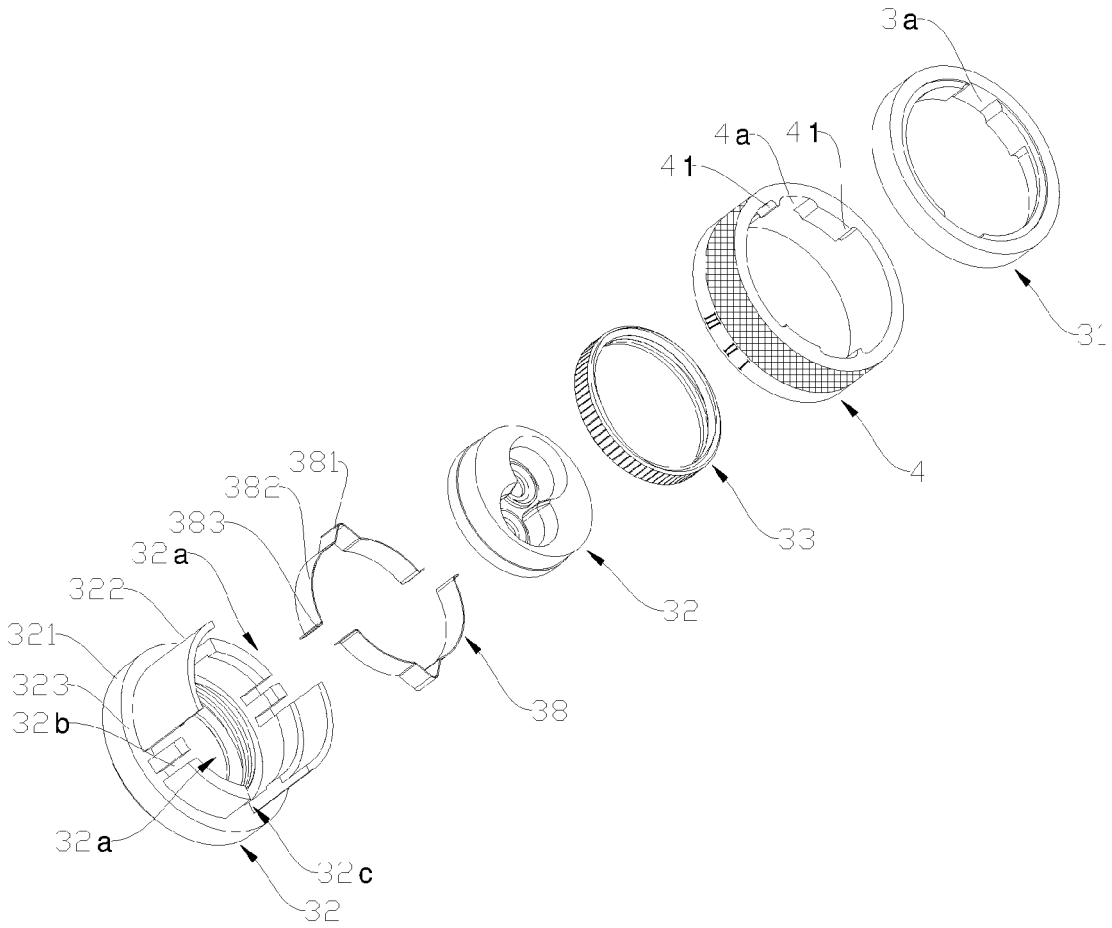
FIG. 3 is a partial explosion view of the electronic cigarette according to one aspect of the embodiment shown in FIG. 1.

Specifically, the gear adjusting mechanism may be defined as shown in FIG. 3. In FIG. 3, at least a pair of first protrusions 41 is defined on the inner wall of a portion of the second adjustment element 4, wherein the portion of the second adjustment is away from the connection base 32. Both first protrusions 41 of each pair are distributed with spacing, and the second inlet passageway 4*a* is formed between both first protrusions 41 of each pair distributed with spacing.

Figure 4:
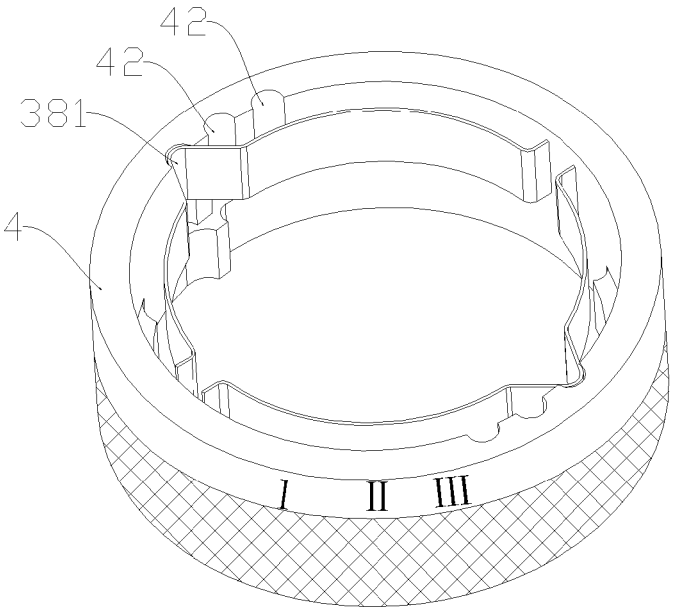
FIG. 4 is a schematic view of a second adjustment element shown in FIG. 3.

At least a pair of second protrusions 301 is defined on the inner wall of the adjustment ring 31. Both second protrusions 301 of each pair are distributed with spacing, and the first inlet passageway 3*a* is formed between both second protrusions 301 of each pair distributed with spacing. As shown in FIG. 4, at least two recessed portions 42, preferably three, are defined in a portion of the second adjustment element 4, wherein the portion of the second adjustment element is closed to the connection base 32. Each of the recessed portions 42 is defined in the inner wall of the second adjustment element 4 and is in groove shape.

In the connection base 32 of the first adjustment element 3, a doughnut-shaped step surface 323 is formed at a joint of the first connecting portion 321 and the second connecting portion 322. At least one notch 32*a* is defined on one end of the second connecting portion 322, wherein the end of the second connecting portion 322 is away from the first connecting portion 321. Each notch 32*a* runs through a side wall of the second connecting portion 322. At least one snap slot 32*b* and a through-trough 32*c* are defined with spacing in the bottom of each notch 32*a*. In the embodiment, there are two notches 32*a*, and the two notches are defined oppositely to each other.

The first adjustment element 3 further comprises at least one elastic element 38. Each elastic element 38 comprises an arc-shaped elastic strip 382. The middle portion of the elastic strip 382 upheaves outwardly to form the raised portion 381 of the gear adjusting mechanism. A connection piece 383 is respectively arranged on the both ends of the elastic strip 382 around the circumferential direction.

When installing, the second adjustment element 4 and the adjustment ring 31 are sleeved on the second connecting portion 322, with the ends of the second adjustment element 4 and the adjustment ring 31 contacted to each other. Wherein, the second adjustment 4 is located between the adjustment ring 31 and the first connecting portion 321. One end of the second adjustment element 4 abuts against the step surface 323. The first protrusion 41 of the second adjustment element 4 is slidably received in the notch 32*a* and is configured to be rotatable around the axis of the second connecting portion 322. The elastic strip 382 of the elastic element 38 is distributed along the inner wall of the second connecting portion 322, and the connection pieces 383 of the elastic element 38 is inserted in corresponding snap slot 32*b*. The raised portion 381 extends outside the second connecting portion 322 through the through-trough 32*c* and is optionally engaged with a correspondingly recessed portion 42 of the at least two recessed portions 42 to choose a corresponding gear. When the internal threaded sleeve 33 is installed in the second connecting portion 322 of the connection base 32, the outer side wall of the internal threaded sleeve 33 abuts against the first protrusion 41 of the second adjustment element 4 and the second protrusion 301 of the adjustment ring 31. When the external threaded sleeve 51 arranged on an end of the shell 5 is screwed to the internal threaded sleeve 33, the outer side wall of the shell 5 is also abuts against the inside of the second protrusion 301, and an end of the shell 5 abuts against an end of the internal threaded sleeve 33.

Figure 5:
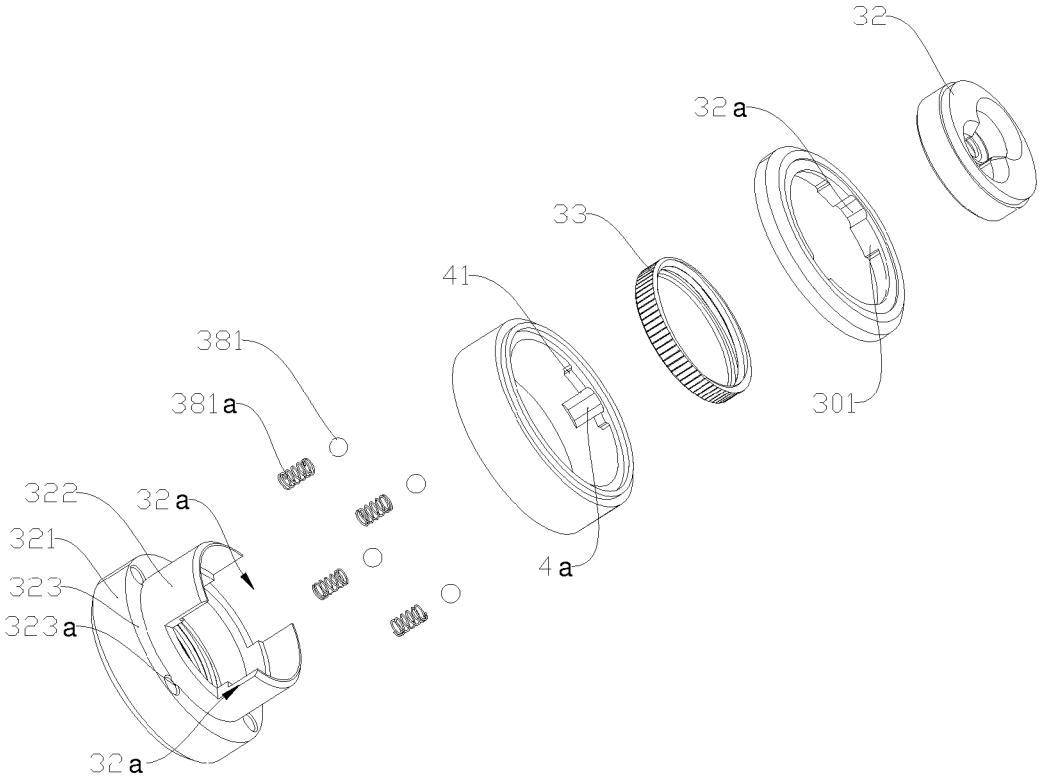
FIG. 5 is a partial explosion view of the electronic cigarette according to another aspect of the embodiment shown in FIG. 1.

It is understood that the gear adjusting mechanism may also be defined as shown in FIG. 5. In FIG. 5, at least a pair of first protrusions 41 is defined on the inner wall of a portion of the second adjustment element 4, wherein the portion of the second adjustment element 4 is away from the connection base 32. The pair of the first protrusions 41 are distributed with spacing, and the second inlet passageway 4*a* is formed between the pair of the first protrusions 41.

Figure 6:
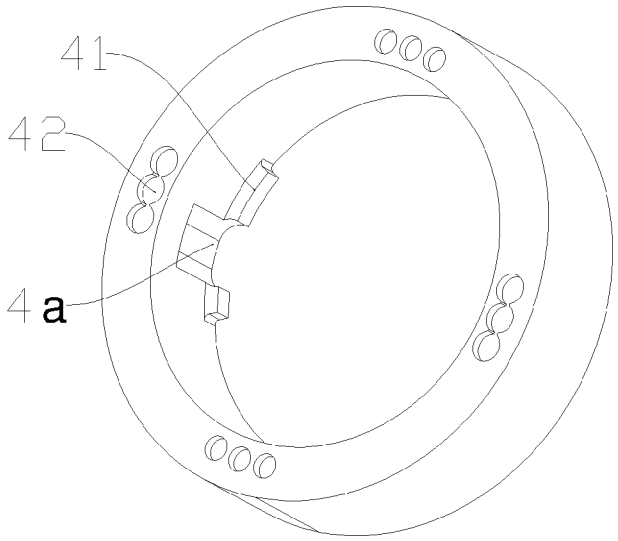
FIG. 6 is a schematic view of a second adjustment element shown in FIG. 5.

At least one pair of second protrusions 301 is defined on the inner wall of the adjustment ring 31. The pair of the second protrusions 301 are distributed with spacing, and the first inlet passageway 3*a* is formed between the pair of the second protrusions 301. As shown in FIG. 6, at least two recessed portions 42 are defined in one end of the second adjustment element 4, wherein the end of the second adjustment element 4 is closed to the connection base 32. There are 12 recessed portions which are divided into four groups in the embodiment, and each group comprises 3 recessed portions. Each of the recessed portions 42 is defined at one end of the second adjustment element 4, wherein the end of the second adjustment element is closed to the connection base 32. Each of the recessed portions 42 is in a groove shape.

In the connection base 32 of the first adjustment element 3, a doughnut-shaped step surface 323 is formed at a joint of the first connecting portion 321 and the second connecting portion 322. Two notches 32*a* opposite to each other are defined in one end of the second connecting portion 322, wherein the end of the second connection portion 322 is away from the first connecting portion 321. Each of the notches 32*a* runs through a side wall of the second connecting portion 322. At least one installation hole 323*a* is defined on the step surface 323. Preferably, three installation holes 323*a* are defined corresponding to four groups of recessed portions.

In the embodiment, preferably, the raised portion 381 is in a ball shape and the amount of the raised portion 381 is four. The recessed portion 42 is in the shape adapted to the raised portion 381. The raised portion 381 in a ball shape is favorable for sliding into or off the recessed portion 42, thus enabling fluent operation when adjusting the ventilation area. The first adjustment element 3 further comprises four springs 381*a*. One end of the spring 381*a* is installed in a corresponding installation hole 323*a*. The raised portion 381 is secured in the other end of the spring 381*a*.

When installing, the second adjustment element 4 and the adjustment ring 31 are sleeved on the second connecting portion 322, with the ends of the second adjustment element 4 and the adjustment ring 31 contacted to each other. Wherein, the second adjustment 4 is located between the adjustment ring 31 and the first connecting portion 321. An end of the second adjustment element 4 abuts against the step surface 323. The first protrusion 41 of the second adjustment element 4 is slidably received in the notch 32*a* and is configured to be rotatable around an axis of the second connecting portion 322. When the installation hole 323*a* of the step surface 323 is not aligned with the recessed portion 42 during the rotation of the second adjustment element 4 with respect to the first adjustment element 3, the spring 381*a* is under compression, and the raised portion 381 abuts against an end of the second adjustment element 4 and is received in the installation hole 323*a*. When the installation hole 323*a* is just aligned with one of the recessed portions, the raised portion 381 will extend outside the installation hole 323*a* under the elastic force of the spring 381*a*, and will further be engaged with the recessed portion 42, thus the ventilation area is in a corresponding gear.

When the internal threaded sleeve 33 is installed in the second connecting portion 322 of the connection base 32, the outer side wall of the internal threaded sleeve 33 abuts against the first protrusion 41 of the second adjustment element 4 and the second protrusion 301 of the adjustment ring 31. When the external threaded sleeve 51 arranged on an end of the shell 5 is screwed to the internal threaded sleeve 33, the outer side wall of the shell 5 is also abuts against the inside of the second protrusion 301, and the end of the shell 5 abuts against an end of the internal threaded sleeve 33.

It is understood that the first inlet passageway 3*a* may also be a through-hole defined on the side wall of the adjustment ring 31 along an axis of adjustment ring 31, and the second inlet passageway 4*a* may also be a through-hole defined on the side wall of the second adjustment element 4 along an axis of the second adjustment element 4.

In conclusion, the first adjustment element 3 is configured to be rotatable with respect to the second adjustment element 4 to adjust the ventilation area at the joint of the first inlet passageway 3*a* and the second inlet passageway 4*a*, thus satisfying the user's requirement for different air inflow rates.

As a gear adjusting mechanism is further arranged between the first adjustment element 3 and the second adjustment element 4 to further fix user's requirement for different air inflow rates at limited gears, thus it is convenient for the user quickly choosing the needed air input.

As the first inlet passageway 3*a* is defined along the axis of the first adjustment element 3, it has the advantageous effects of preventing the first inlet passageway 3*a* from being blocked when the user is holding the electronic cigarette.

While the embodiments of the present application have been described with reference to the drawings, the present application will not be limited to above embodiments that are illustrative but not limitative. It will be understood by those skilled in the art that various changes and equivalents may be substituted in the light of the present application without departing from the scope of the present application, and those various changes and equivalents shall fall into the protection of the application.

The invention claimed is:

1. An electronic cigarette comprising an electronic cigarette body (1) and a suction nozzle assembly (2) arranged at one end of the electronic cigarette body (1), wherein the electronic cigarette body (1) comprises at least one atomization assembly (11) used to atomize tobacco tar and a battery assembly (12) used to power each atomization assembly (11); a smoke passageway (11*a*) is defined in the each atomization assembly (11) to discharge smoke produced by the each atomization assembly (11); one end of the smoke passageway (11*a*) is communicated with the suction nozzle assembly (2); and wherein a first adjustment element (3) and a second adjustment element (4) are sleeved on a joint of the electronic cigarette body (1) and the suction nozzle assembly (2), a first inlet passageway (3*a*) configured for air inflow is defined in the first adjustment element (3) along an axis of the electronic cigarette body (1); a second inlet passageway (4*a*) communicated with the other end of the smoke passageway (11*a*) and the first inlet passageway (3*a*) is defined in the second adjustment element (4) along the axis of the electronic cigarette body (1); the second adjustment element (4) is configured to be rotatable with respect to the first adjustment element (3) to adjust ventilation area of a joint of the first inlet passageway (3*a*) and the second inlet passageway (4*a*); a gear adjusting mechanism is arranged at the first adjustment element (3) and the second adjustment element (4) to control the ventilation area;

wherein the gear adjusting mechanism comprises at least one raised portion (381) and at least two recessed portions (42) matched with each raised portion (381); during the rotation of the first adjustment element (3) with respect to the second adjustment element (4), the each raised portion (381) is optionally engaged with one of the recessed portions (42) to keep the ventilation area in corresponding gear; and wherein the first adjustment element (3) comprises a connection base (32) and an adjustment ring (31); the connection base (32) comprises a first connecting portion (321) and a second connecting portion (322) formed with a diameter shrinkage along an axis of the first connecting portion (321); the suction nozzle assembly (2) is connected to the first connecting portion (321); the adjustment ring (31) is fixedly sleeved on the second connecting portion (322); the second adjustment element (4) is rotationally sleeved on the second connecting portion (322) along an axis of the second connecting portion (322) and located between the first connecting portion (321) and the adjustment ring (31); the first inlet passageway (3*a*) is arranged on a side wall of the adjustment ring (31) along an axis of the adjustment ring (31).

2. The electronic cigarette according to claim 1, wherein at least one pair of first protrusions (41) is defined on an inner wall of the second adjustment element (4); both first protrusions (41) of each pair of the first protrusions (41) are distributed with spacing, and the second inlet passageway (4*a*) is formed between the both first protrusions (41) of the each pair of the first protrusions (41) distributed with spacing;

at least one pair of second protrusions (301) is defined on an inner wall of the first adjustment element (3); both second protrusions (301) of each pair of the second protrusions (301) are distributed with spacing, and the first inlet passageway (3*a*) is formed between both second protrusions (301) of the each pair of the second protrusions (301) distributed with spacing.

3. The electronic cigarette according to claim 2, wherein the first connecting portion (321) and the second connecting portion (322) are both in a circular-tube shape; at least one notch (32*a*) is defined on one end of the second connecting portion (322) and the end of the second connecting portion (322) is opposite to the first connecting portion (321); each notch (32*a*) runs through a side wall of the second connecting portion (322); when the second adjustment element (4) is sleeved on the second connecting portion (322), the each pair of the first protrusions (41) are rotatable around the axis of the second connecting portion (322) to be received in the each notch (32*a*).

4. The electronic cigarette according to claim 3, wherein an outer diameter of first connecting portion (321) is greater than that of the second connecting portion (322); a doughnut-shaped step surface (323) is formed at a joint of the first connecting portion (321) and the second connecting portion (322); an end of the second adjustment element (4) abuts against the step surface (323); at least one installation hole (323*a*) is defined on the step surface (323); the first adjustment element (3) further comprises at least one spring (381*a*); one end of each spring (381*a*) is installed in a corresponding installation hole (323*a*); the each raised portion (381) is connected to the other end of the spring (381*a*); the recessed portions (42) are arranged on the end abutting against the step surface (323) and are in a groove shape.

5. The electronic cigarette according to claim 4, wherein the raised portion (381) is in a ball shape.

6. The electronic cigarette according to claim 3, wherein the first adjustment element (3) further comprises an elastic element (38); the elastic element (38) comprises an arc-shaped elastic strip (382) and two connection pieces (383) arranged on both ends of the elastic strip (382) respectively; a middle portion of the elastic strip (382) upheaves outwardly to form the raised portion (381); the recessed portions (42) are formed on a corresponding position of the inner wall of the second adjustment element (4), the recessed portions (42) are in a groove shape;

at least one snap slot (32*b*) and a through-trough (32*c*) are defined at a bottom of the each notch (32*a*); the elastic strip (382) is distributed along an inner side wall of the second connecting portion (322); the connection pieces (383) are clamped in corresponding snap slot (32*b*); the raised portion (381) is configured to extend outside the through-trough (32*c*) and is optionally engaged with one of the recessed portions (42).

7. The electronic cigarette according to claim 6, wherein the electronic cigarette body (1) further comprises a shell (5); the at least one atomization assembly (11) and the battery assembly (12) are both received in the shell (5).

8. The electronic cigarette according to claim 7, wherein an external threaded sleeve (51) is arranged at one end of the shell (5); the first adjustment element (3) further comprises an internal threaded sleeve (33); the internal threaded sleeve (33) is fixed inside the second connecting portion (322); an outer side wall of the internal threaded sleeve (33) abuts against the each pair of the second protrusions (301) and the each pair of the first protrusions (41); the external threaded sleeve (51) is screwed to the internal threaded sleeve (33); an end of the shell (5) abuts against an end of the internal threaded sleeve (33).

9. The electronic cigarette according to claim 8, wherein the each atomization assembly (11) comprises a tobacco tar latching element (111) used to store the tobacco tar and a heating component (112) used to atomize the tobacco tar; the smoke passageway (11*a*) is formed in a middle portion of the tobacco tar latching element (111); and the heating component (112) is installed in the smoke passageway (11*a*).

10. The electronic cigarette according to claim 9, wherein an air passageway communicated with one end of smoke passageway (11*a*) and the second inlet passageway (4*a*) is formed between the atomization support (110) and the shell (5), and the end of the smoke passageway (11*a*) is opposite to the suction nozzle assembly (2).

11. The electronic cigarette according to claim 9, wherein the electronic cigarette body (1) further comprises an atomization support (110), the at least one atomization assembly (11) is axially provided in the atomization support (110) in parallel; the battery assembly (12) comprises a battery support and a battery arranged in the battery support; the atomization support (110) and the battery support are coaxially provided in the shell (5); the atomization support (110) is located between the battery support and the suction nozzle assembly (2).

12. The electronic cigarette according to claim 11, wherein an internal threaded portion is defined in one end of the first connecting portion (321) and the end of the first connecting portion (321) is closed to the suction nozzle assembly (2); an external threaded portion (21) is defined at one end of the suction nozzle assembly (2) and the end of the suction nozzle assembly (2) is closed to the first connecting portion (321); the external threaded portion (21) is screwed to the internal threaded portion.

13. An electronic cigarette comprising an electronic cigarette body (1) and a suction nozzle assembly (2) arranged at one end of the electronic cigarette body (1), the electronic cigarette body (1) comprises at least one atomization assembly (11) used to atomize tobacco tar and a battery assembly (12) used to power each atomization assembly (11); a smoke passageway (11*a*) is defined in the each atomization assembly (11) to discharge smoke produced by the each atomization assembly (11); one end of the smoke passageway (11*a*) is communicated with the suction nozzle assembly (2);

wherein a first adjustment element (3) and a second adjustment element (4) are sleeved on a joint of the electronic cigarette body (1) and the suction nozzle assembly (2); a first inlet passageway (3*a*) configured for air inflow is defined in the first adjustment element (3) along an axis of the electronic cigarette body (1); a second inlet passageway (4*a*) communicated with the other end of the smoke passageway (11*a*) and the first inlet passageway (3*a*) is defined in the second adjustment element (4) along the axis of the electronic cigarette body (1); the second adjustment element (4) is configured to be rotatable with respect to the first adjustment element (3) to adjust ventilation area at a joint of the first inlet passageway (3*a*) and the second inlet passageway (4*a*); a gear adjusting mechanism is arranged at the first adjustment element (3) and the second adjustment element (4) to control the ventilation area;

wherein the gear adjusting mechanism comprises at least one raised portion (381) and at least two recessed portions (42) matched with each raised portion (381); during a rotation of the first adjustment element (3) with respect to the second adjustment element (4), the each raised portion (381) is optionally engaged with one of the recessed portions (42) to keep the ventilation area in corresponding gear;

wherein the atomization assembly (11) comprises a tobacco tar latching element (111) and a heating component (112); the tobacco tar latching element (111) is in a circular-tube shape; the smoke passageway (11*a*) is formed in the tobacco tar latching element (111); the heating component (112) is provided in the smoke passageway (11*a*); and wherein the first adjustment element (3) comprises a connection base (32) and an adjustment ring (31); the connection base (32) comprises a first connecting portion (321) and a second connecting portion (322) formed with a diameter shrinkage along an axis of the first connecting portion (321); the suction nozzle assembly (2) is connected to the first connecting portion (321); the adjustment ring (31) is fixedly sleeved on the second connecting portion (322); the second adjustment element (4) is rotationally sleeved on the second connecting portion (322) along an axis of the second connecting portion (322) and located between the first connecting portion (321) and the adjustment ring (31); the first inlet passageway (3*a*) is arranged on a side wall of the adjustment ring (31) along an axis of the adjustment ring (31); an outer diameter of first connecting portion (321) is greater than that of the second connecting portion (322); a doughnut-shaped step surface (323) is formed at a joint of the first connecting portion (321) and the second connecting portion (322); an end of the second adjustment element (4) abuts against the step surface (323); at least one installation hole (323*a*) is defined on the step surface (323); the first adjustment element (3) further comprises at least one spring (381*a*); one end of each spring (381*a*) is installed on a corresponding installation hole (323*a*); the each raised portion (381) is connected to the other end of the spring (381*a*); the recessed portions (42) are arranged on the end abutting against the step surface (323) and are in groove shape.

* * * * *